US006413434B1

(12) United States Patent
Nedez

(10) Patent No.: US 6,413,434 B1
(45) Date of Patent: Jul. 2, 2002

(54) METHOD FOR ELIMINATING HALOGENATED COMPOUNDS CONTAINED IN A GAS OR LIQUID

(75) Inventor: Christophe Nedez, Salindres (FR)

(73) Assignee: Institut Francais du Petrole, Rueil-Malmaison Cedex (FR)

( * ) Notice: Subject to any disclaimer, the term of this patent is extended or adjusted under 35 U.S.C. 154(b) by 0 days.

(21) Appl. No.: 09/622,008

(22) PCT Filed: Feb. 9, 1999

(86) PCT No.: PCT/FR99/00275

§ 371 (c)(1),
(2), (4) Date: Oct. 19, 2000

(87) PCT Pub. No.: WO99/40999

PCT Pub. Date: Aug. 19, 1999

(30) Foreign Application Priority Data

Nov. 2, 1998 (FR) ..... 98 01631

(51) Int. Cl.[7] ..... B01J 32/00

(52) U.S. Cl. ..... 210/749; 210/757; 210/915; 423/240 R; 502/20; 502/35; 502/300; 502/340; 502/344

(58) Field of Search ..... 210/749, 757, 210/915; 423/240 R; 502/20, 35, 300, 340, 344

(56) References Cited

U.S. PATENT DOCUMENTS

| | | | | |
|---|---|---|---|---|
| 2,391,149 | A | * | 12/1945 | Frey |
| 4,036,940 | A | | 7/1977 | McLane et al. ..... 423/503 |
| 4,206,148 | A | * | 6/1980 | Biola et al. |
| 4,594,231 | A | | 6/1986 | Nishino et al. ..... 423/210 |
| 4,639,259 | A | | 1/1987 | Pearson ..... 55/71 |
| 5,505,926 | A | * | 4/1996 | Lee et al. |
| 5,585,082 | A | * | 12/1996 | Zimmerman et al. |
| 5,688,479 | A | | 11/1997 | Chao ..... 423/240 |
| 5,695,634 | A | * | 12/1997 | Neuenfeldt et al. |
| 5,895,636 | A | * | 4/1999 | Nguyen et al. |
| 6,060,033 | A | * | 5/2000 | Cheng |
| 6,200,544 | B1 | * | 3/2001 | Blachman |

FOREIGN PATENT DOCUMENTS

| | | |
|---|---|---|
| EP | 233 394 | 8/1987 |
| EP | 243 433 | 9/1987 |
| EP | 301 272 | 2/1989 |
| EP | 546464 | 6/1993 |
| JP | 9225296 | 9/1997 |

OTHER PUBLICATIONS

Patent Abstracts of Japan, vol. 98, No. 001, Jan. 30, 1998, & JP 09225296, Toyo, Sep. 2, 1997.
JP9225296—English Abstract.

* cited by examiner

*Primary Examiner*—Betsey Morrison Hoey
(74) *Attorney, Agent, or Firm*—Millen, White, Zelano & Branigan, P.C.

(57) ABSTRACT

The present invention concerns a process for eliminating, reducing and/or suppressing halogenated compounds, in particular chlorinated compounds, contained in a gas or a liquid, in which the gas or liquid is brought into contact with a composition obtained by depositing at least one compound comprising at least one element selected from alkalis on an alumina, followed by calcining the alumina at a temperature of at least 600° C.

When at least one compound comprising at least one element selected from alkaline-earths and rare earths is deposited on the alumina, the alumina calcining temperature is at least 500° C.

25 Claims, No Drawings

METHOD FOR ELIMINATING HALOGENATED COMPOUNDS CONTAINED IN A GAS OR LIQUID

The present invention relates to a process for eliminating, reducing and/or suppressing halogenated compounds, in particular chlorinated compounds, contained in a gas or a liquid. In some industrial applications, it is necessary to eliminate halogenated compounds, in particular chlorinated compounds, which contaminate the stream, whether it is gaseous or a liquid.

By way of illustration, halogenated compounds, in particular chlorinated compounds contained in the gas or liquid from catalytic reforming, are eliminated in the petroleum industry.

One aim of catalytic reforming is to obtain hydrocarbons with an increased octane number. Hydrocarbon cyclisation and aromatisation reactions are thus desirable since the octane number of a hydrocarbon is higher when it is branched, cyclic or even aromatic. Catalytic reforming produces hydrogen in parallel.

Normally, these hydrocarbon cyclisation and aromatisation reactions take place in the presence of heterogeneous bimetallic chlorinated catalysts. Such chlorinated catalysts are based on alumina and usually comprise platinum and another metal such as tin, rhenium or iridium. The presence of chlorine in said catalysts is important as when added to alumina, it provides the system with an overall acidity and participates in re-dispersing the platinum over time and thus stabilises the catalytic activity of the catalyst.

However, adding chlorine is not a solution without disadvantages. It has been shown that over time, the chlorine partially elutes, in particular in the form of HCl. Such elution means that the catalyst must constantly be recharged with chlorine. It also leads to the presence of HCl and other chlorinated compounds in the gaseous and liquid effluents from catalytic reforming, which can lead to a problem with corrosion of the facility and to the formation of other products which are undesirable and a nuisance to the operation of the facility.

A catalytic reforming process is conventionally operated at high pressure, usually about 20 bars or even higher.

Regenerative processes or new generation processes have recently been developed and are being further developed in the field. Such processes are characterized by being operated at substantially lower pressures, around 3 to 15 bars, or even lower.

The effluents leaving a traditional reforming process contain mainly hydrogen, light saturated hydrocarbons such as methane, ethane. . . , traces of chlorinated compounds, in particular HCl, and water.

The Applicant has surprisingly and unexpectedly discovered that in regenerative processes, traditional adsorbents used up to now in catalytic reforming at higher pressure, based in a high specific surface area alumina, optionally comprising an alkali or alkaline-earth compound, have substantial disadvantages.

Downstream of regenerative processes, and probably because of the lower pressure operation, in addition to hydrogen, light saturated hydrocarbons, traces of chlorinated compounds in particular HCl, and water, the presence of traces of unsaturated hydrocarbons such as ethylene, propylene, butadiene, . . . , has also been observed.

The traces of unsaturated hydrocarbons present in the streams downstream of regenerative processes are at least partially transformed into organo-chlorinated compounds in the presence of chlorinated compounds when in contact with the alumina. Such organo-chlorinated compounds, after multiple reactions with each other and/or with other unsaturated compounds also present in the stream and at the surface of prior art adsorbants, lead to the production of chlorinated oligomers which are aromatic to a greater or lesser extent and have high molecular weights, known as green oils.

After their formation, green oils can no longer be eliminated by traditional adsorbents and migrate in the direction downstream of the adsorber. They can then cause blockages in the facility. Further, a significant drop in the service life of the adsorbent is noted: in some cases, a fall of 4 to 5 times has been observed.

The aim of the present invention is to provide a process which can use a composition which substantially reduces or even suppresses the formation of halogenated oligomers, and in particular chlorinated oligomers known as green oils.

The present invention also aims to provide a process which uses a composition which can more efficiently eliminate halogenated compounds, in particular chlorinated compounds, contained in a gas or a liquid.

These aims are achieved by the present invention which provides a process for eliminating halogenated compounds and for reducing or suppressing the formation of halogenated oligomers contained in a gas or a liquid.

The expression "process for eliminating, reducing and/or suppressing halogenated compounds" as used below designates a "process for eliminating, reducing and/or suppressing both organic and inorganic halogenated compounds and high molecular weight halogenated oligomers". This expression also designates the process aimed at preventing the formation of the halogenated oligomers cited above.

In a first variation, the invention concerns a process for eliminating, reducing and/or suppressing halogenated compounds contained in a gas or a liquid, characterized in that the gas or liquid is brought into contact with a composition obtained by depositing on alumina at least one compound comprising at least one element selected from alkalis on an alumina, followed after deposition by calcining the alumina at a temperature of at least 600° C.

In a second variation, the invention concerns a process for eliminating, reducing and/or suppressing halogenated compounds contained in a gas or a liquid, characterized in that the gas or liquid is brought into contact with a composition obtained by depositing at least one compound comprising at least one element selected from alkaline-earths and rare earths on an alumina, followed after deposition by calcining the alumina at a temperature of at least 500° C., more particularly at least 600° C.

In a third variation, the invention concerns a process for eliminating, reducing and/or suppressing halogenated compounds contained in a gas or a liquid, characterized in that the gas or liquid is brought into contact with a composition obtained by depositing at least one compound comprising at least one element selected from alkalis on an alumina, followed after deposition by calcining the alumina at a temperature of at least 600° C., said composition having a specific surface area of at most 110 $m^2/g$.

In a fourth variation, the invention concerns a process for eliminating, reducing and/or suppressing halogenated compounds contained in a gas or a liquid, characterized in that the gas or liquid is brought into contact with a composition obtained by depositing at least one compound comprising at least one element selected from alkalis on an alumina, followed after deposition by calcining the alumina at a temperature of at least 500° C., more particularly at least 600° C., said composition having a specific surface area of at most 140 $m^2/g$.

Finally, in a fifth variation, the invention concerns a process for eliminating, reducing and/or suppressing halogenated compounds contained in a gas or a liquid, characterized in that the gas or liquid is brought into contact with a composition obtained by depositing at least one compound comprising at least one element selected from the rare earths on an alumina, followed after deposition by calcining the alumina at a temperature of at least 500° C., more particularly at least 600° C., said composition having a specific surface area of at most 250 $m^2/g$.

The upper temperature for the calcinations of alumina preferably does not 1200° C.

The composition used in the process of the present invention can be in a variety of forms. As an example, it can be in the form of powders, beads, extrudates, compresses, or monoliths.

The first essential constituent of the composition is alumina.

The specific surface area of the starting alumina is generally at least 30 $m^2/g$, preferably at least 100 $m^2/g$, more preferably at least 200 $m^2/g$.

In the present invention, all specific surface areas quoted are surface areas measured using the BET method. The term "surface area measured using the BET method" means the specific surface area measured by nitrogen adsorption in accordance with American Standard ASTM D 3663-78 based on the BRUNAUER-EMETT-TELLER method described in "The Journal of the American Chemical Society", 60, 309, (1938).

This starting alumina also has a total pore volume (TPV) of at least 15 $cm^3/g$, preferably at least 20 $cm^3/g$, still more preferably at least 25 $cm^3/g$. This total pore volume is measured as follows: the value of the grain density and of the absolute density are determined: the grain density (Dg) and absolute density (Da) are measured using the picnometry method with mercury and helium respectively, and the TPV is given by the formula:

$$[1/Dg]-[1/Da]$$

Processes for preparing aluminas with the total pore volume and specific surface area features required for carrying out the process of the invention are known to the skilled person.

Regarding alumina, the alumina powder used as the starting material to prepare the composition of the invention can be obtained by conventional processes such as a gel or precipitation method, and a process for rapid dehydration of an alumina hydroxide such as a Bayer hydrate (hydrargillite). This latter alumina is that which is preferred.

Regarding alumina beads, they can be produced by an oil drop process. This type of beads can, for example, be prepared as disclosed in European patents EP-A-0 015 801 or EP-A-0 097 539. The porosity can be controlled using the process descibed in EP-A-0 097 539 by oil drop coagulation of an aqueous suspension or dispersion of alumina or a solution of a basic aluminium salt in the form of an emulsion constituted by an organic phase, an aqueous phase and a surfactant or an emulsifying agent. In particular, said organic phase can be a hydrocarbon, and the surfactant or emulsifying agent is, for example Galoryl EM 10®.

Alumina in bead form can also be obtained by agglomeration of an alumina powder. Agglomeration into beads is carried out directly on the alumina powder using rotary techniques. The term "rotary technique" means any apparatus in which agglomeration is carried out by bringing the product to be granulated into rotary contact with itself Examples of apparatus of this type which can be cited are the rotary granulator and the rotary drum. This type of process can produce beads with controlled dimensions and pore distributions, these dimensions and distributions generally being created during the agglomeration step. The pore volume of pores with a given diameter can also be controlled during the agglomeration step by making a suitable adjustment to the rate of introduction of the alumina powder and any water, to the rotation speed of the apparatus or during introduction of a seed.

Alumina extrudates can be obtained by mixing then extruding an alumina-based material, said material possibly being the result of rapid dehydration of hydrargillite or from precipitation of an alumina gel. The porosity of the extrudates can be controlled by the operating conditions used to mix the alumina before extruding. The alumina can also be mixed with pore-forming agents during mixing. As an example, the extrudates can be prepared using the preparation process described in U.S. Pat. No. 3,856,708.

Crushed alumina can be the result of crushing any type of alumina-based material such as beads obtained by any type of process (drop coagulation, rotary granulator or rotary drum) or extrudates. The porosity of such crushed material is controlled by selecting the alumina-based material which is crushed to produce it.

Regardless of the form of the alumina, the porosity can be created by different means such as the choice of the grain size of the alumina powder or the mixture of several alumina powders with different grain sizes. A further method consists of mixing a compound known as a pore-forming agent with the alumina powder before or during the agglomeration or extrusion steps, which agent disappears completely on heating and thus creates pores in the alumina.

Pore-forming agents which can be cited by way of example are wood flour, wood charcoal, sulphur, tars, plastics materials or emulsions of plastics materials such as polyvinyl chloride, polyvinyl alcohols, naphthalene or the like. The quantity of pore-forming agents added is not critical and is determined by the desired pore volume.

Following forming, the alumina obtained can undergo different operations intended to improve its strength, such as maturing by keeping it in an atmosphere with a controlled humidity, followed by calcining then impregnating the alumina with a solution of one or more acids and hydrothermal treatment in a confined atmosphere.

Finally, after these different treatments, the alumina is dried and calcined.

The second essential constituent of the composition is the alkali, alkaline-earth and rare earth element, generally known as the doping element.

The composition of the invention can comprise one element or a combination of alkali and/or alkaline-earth and/or rare earth element(s). Thus in the remainder of the text, any description of a doping element will be applicable to a combination of alkali and/or alkaline-earth and/or rare earth element(s), also known as doping elements.

The doping element, i.e., the alkali, alkaline-earth or rare earth element, can be deposited on the alumina using any method which is known to the skilled person.

It can, for example, be carried out by impregnating the prepared alumina with doping elements or precursors of those elements, or by mixing the doping elements or precursors of those elements with the alumina during or prior to forming the latter. The doping element can also be deposited on the alumina by co-precipitation of the alumina and the doping elements or their precursors.

In the case of depositing by impregnation, this is effected in known manner by bringing the alumina into contact with a solution, a sol or a gel comprising at least one doping element in the form of an oxide or a salt or one of its precursors.

The operation is generally carried out by immersing the alumina in a set volume of a solution of at least one precursor of at least one doping element. The term "solution of a precursor of a doping, element" means a solution of at least one salt or at least one compound of the doping element or elements, these salts and compounds being heat decomposable.

The concentration of the salt of the solution is selected as a function of the doping element to be deposited on the alumina.

The impregnation surface of the doping element is determined by the adsorbed volume of solution. Thus the adsorbed volume of the doping element is equal to the total pore volume of the alumina to be impregnated. It is also possible to impregnate the alumina by immersing it in the solution of the doping element precursor and eliminating the excess solution by draining.

In a preferred mode, the doping element is deposited by dry impregnation.

The compounds which can be deposited on the alumina can be selected from organic or inorganic compounds. They are preferably selected from inorganic compounds.

More particularly, the term "inorganic compounds" means inorganic salts such as carbonates, bicarbonates, cyanides, cyanates, alkoxylates, hydroxides and nitrates.

The specific surface area of the composition after calcining, when the doping element is at least one element selected from the rare earths, is at most 250 $m^2/g$, preferably at most 200 $m^2/g$, more preferably at most 150 $m^2/g$.

More particularly, the specific surface area of the composition after calcining, independently of the nature of the doping element, is at least 5 $m^2/g$, preferably at least 10 $m^2/g$, and more preferably at least 20 $m^2/g$.

When depositing the compound comprising at least one element selected from alkalis, alkaline-earths and rare earths on the alumina, the concentration of the solution of the compound is selected such that the overall weight content of the alkali, alkaline-earth or rare earth elements in the composition is in the range 0.5% to 70% by weight with respect to the total composition weight.

Preferably, this amount is in the range 0.5% to 40% by weight, more preferably in the range 2% to 35% by weight, with respect to the total composition weight.

Without wishing to be bound by any particular theory, it can be considered that the substantial improvement in elimination of halogenated compound such as HCl and the substantial reduction or even suppression of the formation of halogenated oligomers in particular chlorinated oligomers known as green oils are probably due to the transformation of at least a portion of the alumina of the composition into an aluminate on calcining at the temperatures indicated above.

During calcining, at least partial inclusion of the compound(s) comprising the element(s) selected from the alkalis, alkaline-earths and rare earths is probable, leading to the formation of the corresponding aluminate.

The aluminate formed should be present in the superficial layers of the composition, which prevents the formation of Al-halogen entities, in particular Al—Cl entities, retained by the composition (the Al-halogen entity, in particular Al—Cl, is formed in the presence of alumina with a high specific surface area, which may be doped, and halogenated compounds, in particular chlorinated compounds contained in the stream), and as a result obstructs their reaction with unsaturated hydrocarbons to produce halogenated compounds, in particular chlorinated oligomers or green oils.

The process of the invention is applicable in all industrial fields requiring the elimination of halogenated compounds, in particular chlorinated compounds such as HCl and/or the reduction or even suppression of the formation of halogenated oligomers, in particular chlorinated oligomers known as green oils contained in a gas or a liquid primarily originating from regenerative catalytic reforming or from new generation.

The term "regenerative catalytic reforming or new generation" normally means processes characterized by being carried out at a pressure of at most 15 bars, more particularly at most 12 bars, for example 3 to 10 bars.

More particularly, the process of the invention is intended to eliminate chlorinated compounds, more particularly to eliminate the HCl present in a gas or a liquid, for substantial reduction and/or suppression of the formation of chlorinated oligomers or green oils also present in the gas or liquid.

As described above, at the outlet from the catalytic reforming, the gaseous effluents are mainly composed of hydrogen, saturated hydrocarbons, traces of unsaturated hydrocarbons, traces of halogenated compounds and water. When the effluents contain water, the water content is generally in the range 1 to 50 ppm by volume, at the pressure of the unit. Under these conditions, the HCl content, for example, is usually in the range 0.2 to 30 ppm by volume.

The process of the invention is also suitable for eliminating halogenated compounds and/or for substantial reduction or even suppression of the formation of chlorinated oligomers or green oils contained in a gas or a liquid which is free of water, or in a gas or liquid containing water.

The term "free of water" means a water content of less than 1 ppm, at the pressure of the unit.

The following examples illustrate the invention without, however, limiting its scope.

EXAMPLES

Example 1

Sample Preparation

Table 1 describes the different samples (compositions) and summarises their preparation conditions.

The alumina of sample 1 was an oxide obtained without doping, with a residual sodium content which is explained by the starting material used (hydrargillite) which is a product of the Bayer cycle. It was granulated into the form of beads with a diameter in the range 2 to 5 mm. The specific surface area of the batch of alumina of sample 1 was 349 $m^2/g$.

To prepare sample 2, the alumina of sample 1 was calcined at a temperature of 750° C. for two hours and then had a specific surface area of 80 $m^2/g$. The alumina was then dry impregnated followed by drying at 100° C. overnight, then a calcining step was carried out for three hours at 350° C.

All of the other samples (compositions) were prepared by dry impregnating the alumina of sample 1 After impregnating, drying was carried out at 100° C. overnight followed by a calcining step carried out at the temperature shown in Table 1 over 3 hours. Table 1 also shows the precursors used to perform the alumina impregnation.

Samples 1, 2 and 3 were comparative examples in accordance with the prior art. Samples 4 to 7 correspond to compositions of the invention.

TABLE I

Samples studied and their mode of preparation

| SAMPLE | ELEMENT X | COMPOUND OF X | X CONTENT (WT %) | CALCINING (° C.) | SURFACE AREA ($m^2/g$) |
|---|---|---|---|---|---|
| 1 | — | — | 0.2 | — | 349 |
| 2 | Na | NaOH | 6.7 | 350 | 52 |
| 3 | Na | NaOH | 6.7 | 400 | 147 |
| 4 | Na | NaOH | 6.7 | 820 | 72 |
| 5 | Na | $NaNO_3$ | 6.7 | 820 | 62 |
| 6 | K | KOH | 10.8 | 820 | 73 |
| 7 | Ca | $Ca(NO_3)_2$ | 9.4 | 800 | 97 |

Detection of Green Oils

Regarding the formation of green oils, an operating mode was carried out to detect, starting from propylene, the formation of organo-chlorinated compounds, initially 2-chloropropane, in a of study compositions.

To this end, 10 g of the composition was placed in a reactor held at 50° C. for 15 hours through which hydrogen containing 2% of propylene, 24 mmoles of HCl and 82 mmoles of water circulated in a closed loop. Examination of the gas phase was carried out in situ by infrared (1300 $cm^{-1}$ band) and mass spectrometric analysis enabled any production of chloropropane to be monitored.

Under these conditions, chloropropane was formed when samples 1, 2 and 3 were used.

In contrast, neither chloropropane nor other chlorinated hydrocarbons was observed to form with compositions 4, 5, 6 and 7.

HCl+$H_2O$ Co-adsorption

The HCl adsorption experiments were carried out in a balance kept in a permanent stream of gas with helium as the vector gas, at atmospheric pressure.

A HCl-$H_2O$ mixture (respectively 9400–500 ppm) was added to the helium (320 ml/min).

The sample in the balance, in an amount of 280 mg, was pre-treated in dry helium at 300° C. for 2 hours. The experiment proper could be started after reducing the temperature and keeping it at 30° C.

Table II summarises the results obtained.

The samples (compositions) were examined after an experimental period of 200 hours.

TABLE II

| | HCl + $H_2O$ CO-ADSORPTION[a] | |
|---|---|---|
| SAMPLES | HCl + $H_2O$ (%) | HCl MEASURED (%) |
| 1 | 16 | 11.3 |
| 2 | 8 | 5.5 |
| 3 | 22 | 15.6 |
| 4 | 24.5 | 16 |
| 5 | 26 | 18.8 |
| 6 | 25 | 16.2 |
| 7 | 25.5 | 17.1 |

*in the case of co-adsorption, the mass increase noted was due both to HCl capture and to water adsorption.

The results clearly show that a non doped and non calcined alumina (sample 1) and/or an alumina which has been doped but calcined at an insufficient temperature of 400° C. (sample 3) and/or an alumina calcined at high temperature but before doping (sample 2) neither reduced nor suppressed the formation of green oils.

Finally, compositions 4 to 7 of the invention prevent the formation of green oils and exhibited better HCl adsorption.

I claim:

1. A process for eliminating, reducing and/or suppressing halogenated compounds comprising HCl contained in a gas or a liquid, comprising contacting the gas or liquid with an adsorbent mass comprising a composition consisting of an alumina or aluminate and at least one compound of an alkali metal, an alkaline earth metal or a rare earth, said composition being obtained by depositing on an alumina, at least one compound of an alkali metal, an alkaline-earth metal or a rare earth, followed after deposition by calcining the alumina at a temperature of at least 600° C., said composition having a specific surface area of at most 110 $m^2/g$ when an alkali metal is deposited, a specific surface area of at most 140 $m^2/g$ when an alkaline-earth metal is deposited, and a specific surface area of at most 250 $m^2/g$ when a rare earth is deposited.

2. A process according to claim 1, wherein the compounds deposited on the alumina are inorganic salts.

3. A process according to claim 1, wherein said compounds comprise at least one element selected from lithium, sodium, potassium, rubidium, caesium, magnesium, calcium, strontium, barium, cerium, praseodymium and lanthanum.

4. A process according to claim 3, wherein the specific surface area of the composition after calcining is at most 120 $m^2/g$.

5. A process according to claim 1, wherein the specific surface area of the composition after calcining is at most 90 $m^2/g$ when an alkali metal or alkaline-earth metal compound is deposited.

6. A process according to claim 1, wherein after depositing, the alumina is calcined at a temperature which does not exceed 1200° C.

7. A process according to claim 6, wherein the specific surface area of the composition after calcining is at most 150 $m^2/g$.

8. A process according to claim 1, wherein the specific surface area of the composition after calcining is at least 5 $m^2/g$.

9. A process according to claim 1, wherein, by weight, the overall content of the alkali, alkaline-earth and rare earth element or elements in the composition is in the range 0.5% to 70% by weight with respect to the weight of the total composition.

10. A process according to claim 9, wherein the overall content of the alkali, alkaline-earth and rare earth element or elements in the composition is in the range of 2% to 35% by weight with respect to the weight of the total composition.

11. A process according to claim 1, wherein the gas or liquid which is brought into contact with the composition is free of water.

12. A process according to claim 1, wherein the gas or liquid which is brought into contact with the composition contains water.

13. A process comprising a preceding step of regenerating a catalyst so as to obtain a gas containing HCl and treating said gas according to claim 1.

14. A process for suppressing the formation halogenated compounds in a gas or a liquid according to claim 1, wherein said halogenated compounds are chlorinated compounds.

15. A process according to claim 1, wherein the specific surface area after calcining is at least 10 $m^2/g$.

16. A process according to claim 1, wherein the specific surface area after calining is at least 20 $m^2/g$.

17. A process according to claim 1, wherein the calcination is conducted at a temperature of at least about 800° C.

18. A process according to claims 1, wherein said adsorbent mass consists essentially of said composition.

19. A process according to claim 1, wherein said adsorbent mass consists of said composition.

20. A process according to claim 1, wherein the compound comprises sodium.

21. A process according to claim 1, wherein the compound comprises potassium.

22. A process according to claim 1, wherein the compound comprises calcium.

23. A process for eliminating, reducing and/or suppressing halogenated compounds contained in a gas or a liquid, comprising contacting the gas or liquid with a composition obtained by depositing on an alumina, at least one compound of an alkali metal, an alkaline-earth metal or a rare earth, followed after deposition by calcining the alumina at a temperature of at least 600° C., said composition having a specific surface area of at most 110 $m^2/g$ when an alkali metal is deposited, a specific surface area of at most 140 $m^2/g$ when an alkaline-earth metal is deposited, and a specific surface area of at most 250 $m^2/g$ when a rare earth is deposited, and wherein the gas or liquid which is brought into contact with the composition contains water.

24. A process comprising a step of regenerating a catalyst so as to obtain a gas containing halogenated compounds, and contacting the resultant gas optionally condensed to a liquid gas or liquid with a composition obtained by depositing on an alumina, at least one compound of an alkali metal, an alkaline-earth metal or a rare earth, followed after deposition by calcining the alumina at a temperature of at least 600° C., said composition having a specific surface area of at most 110 $m^2/g$ when an alkali metal is deposited, a specific surface area of at most 140 $m^2/g$ when an alkaline-earth metal is deposited, and a specific surface area of at most 250 $m^2/g$ when a rare earth is deposited, and wherein the gas or liquid which is brought into contact with the composition contains water.

25. A process for suppressing the formation of chloropropane in a gas or liquid comprising HCl and propylene, comprising contacting the gas or liquid with an adsorbent obtained by depositing on an alumina, at least one compound of an alkali metal, an alkaline-earth metal or a rare earth, followed after deposition by calcining the alumina at a temperature of at least 600° C., said adsorbent having a specific surface area of at most 110 $m^2/g$ when an alkali metal is deposited, said composition having a specific surface area of at most 110 $m^2/g$ when an alkali metal is deposited, a specific surface area of at most 140 $m^2/g$ when an alkaline-earth metal is deposited, and a specific area of at most 250 $m^2/g$ when a rare earth is deposited.

* * * * *